United States Patent [19]

Butt

[11] 4,249,595

[45] Feb. 10, 1981

[54] PLATE TYPE HEAT EXCHANGER WITH BAR MEANS FOR FLOW CONTROL AND STRUCTURAL SUPPORT

[75] Inventor: Alan G. Butt, La Crosse, Wis.

[73] Assignee: The Trane Company, La Crosse, Wis.

[21] Appl. No.: 73,465

[22] Filed: Sep. 7, 1979

[51] Int. Cl.[3] ..... F28F 3/00

[52] U.S. Cl. ..... 165/110; 165/166; 165/174

[58] Field of Search ..... 165/166, 167, 174, 110

[56] References Cited

U.S. PATENT DOCUMENTS

| | | | |
|---|---|---|---|
| 3,282,334 | 11/1966 | Stahlheber | 165/166 |
| 3,310,105 | 3/1967 | Butt | 165/166 |
| 3,495,656 | 2/1970 | Dickson | 165/166 |
| 3,559,722 | 2/1971 | Schauls et al. | 165/166 X |
| 3,612,494 | 10/1971 | Toyama et al. | 261/97 X |
| 3,880,231 | 4/1975 | Gauthier | 165/166 |
| 3,895,676 | 7/1975 | Young | 165/167 |

*Primary Examiner*—Sheldon J. Richter
*Attorney, Agent, or Firm*—Carl M. Lewis; Peter D. Ferguson; Ronald M. Anderson

[57] ABSTRACT

A plate type heat exchanger is shown in which liquid and vaporous phases of a heat exchange fluid are separately distributed uniformly across the width of a heat exchanger and after mixing, flow therethrough in heat exchange relationship with a feed fluid. Crossover means are disposed in the metallic plates separating adjacent passages in which the fluid and vaporous heat exchange fluids flow and are operative to provide fluid communication between the adjacent passages so that the two phases of heat exchange fluid may mix. Slotted metallic bars provide structural support to the metallic plates in the proximity of the crossover means and restrict the flow of one of the liquid and vaporous fluids through the crossover means.

In one embodiment of the invention, the rate of flow of one of the heat exchange fluids through the heat exchanger is continuously adjustable over a limited range by metering control means; in another embodiment, it is controlled in discrete steps. The spacing, width, and/or depth of the slots formed in the slotted metallic bars otherwise determine the rate of fluid flow through the crossover means, for a given pressure drop.

24 Claims, 23 Drawing Figures

FIG. 1
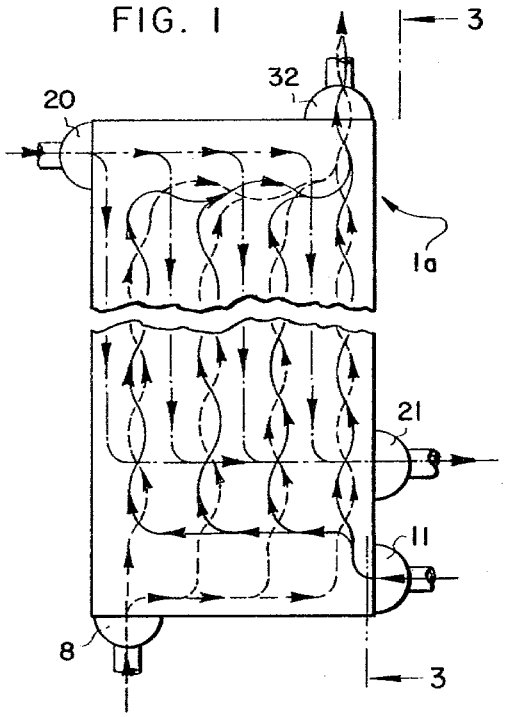
FIG. 2
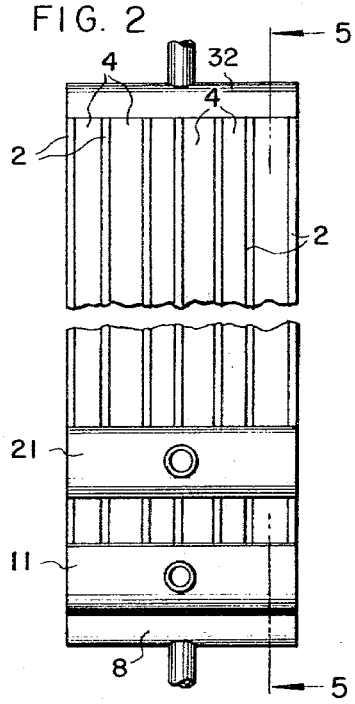
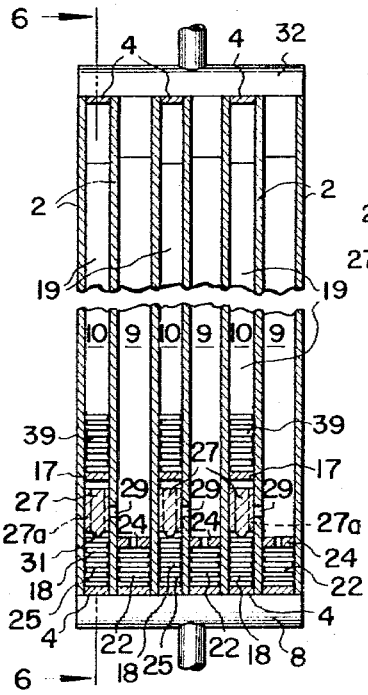
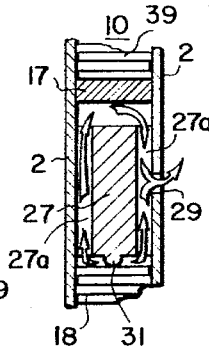
FIG. 3A
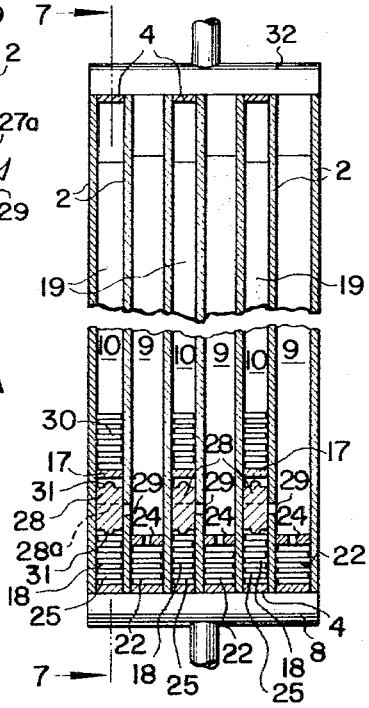
FIG. 3
FIG. 4

FIG. 5
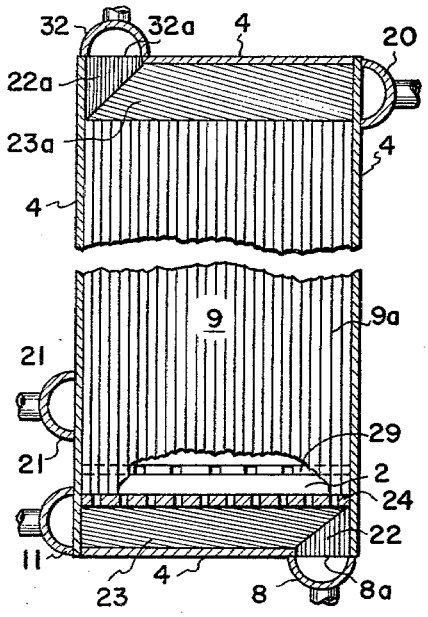
FIG. 6
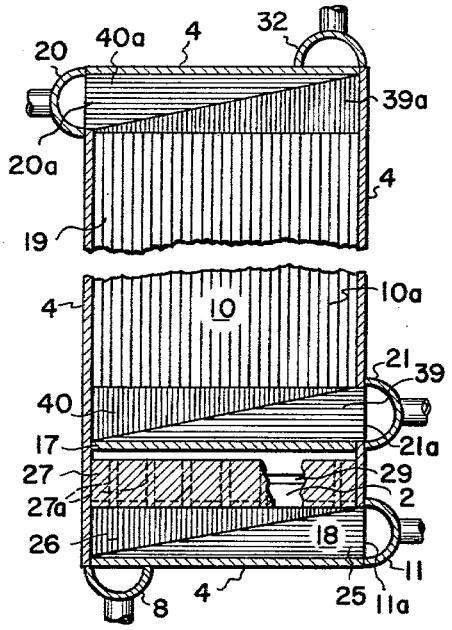
FIG. 10
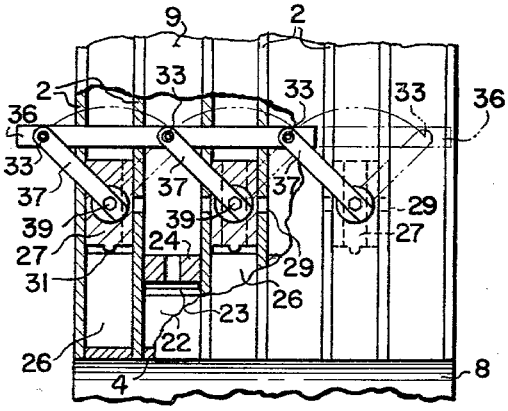
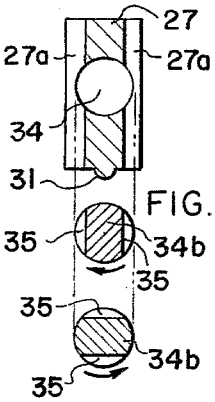
FIG. 10A
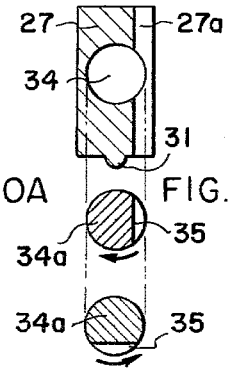
FIG. 10B
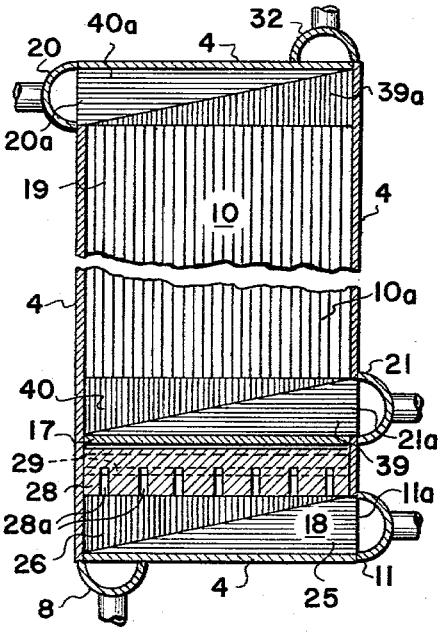
FIG. 7

FIG. 11
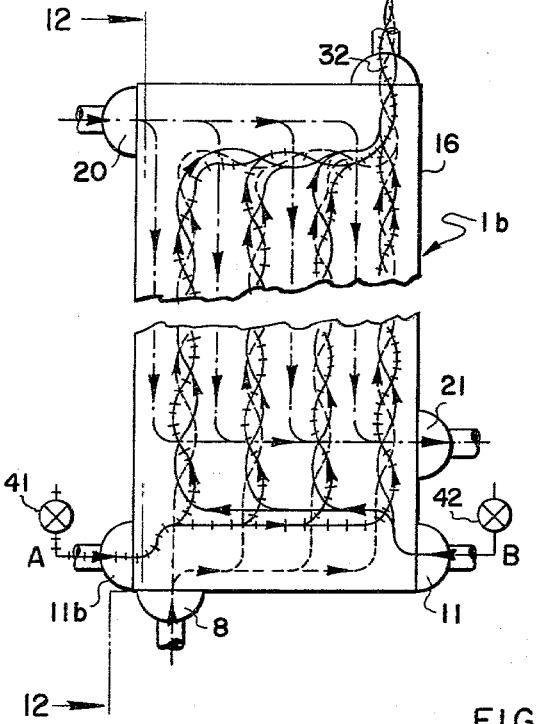
FIG. 12
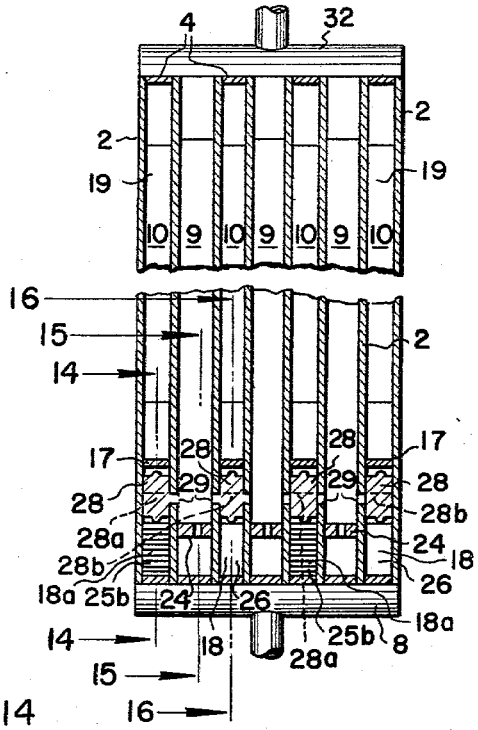
FIG. 13
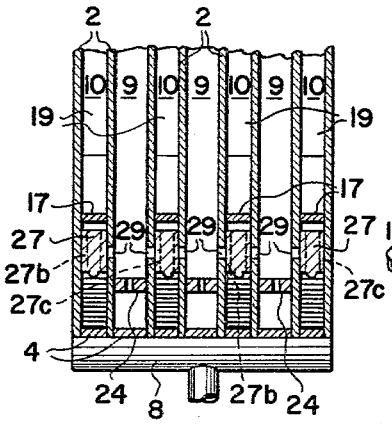
FIG. 14
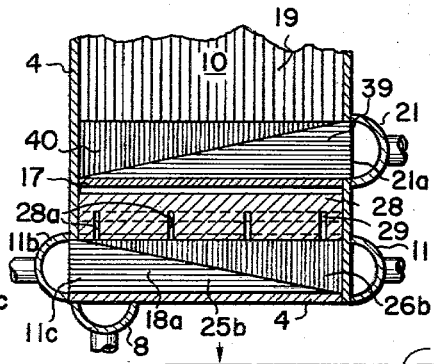
FIG. 17
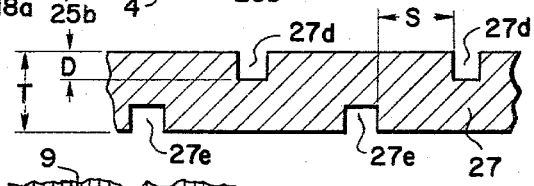
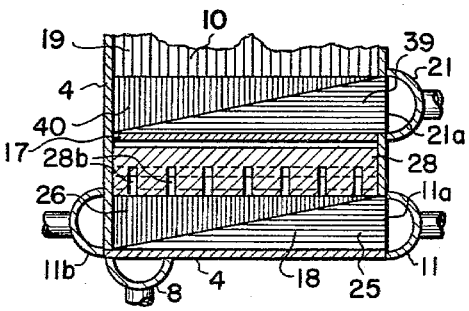
FIG. 16
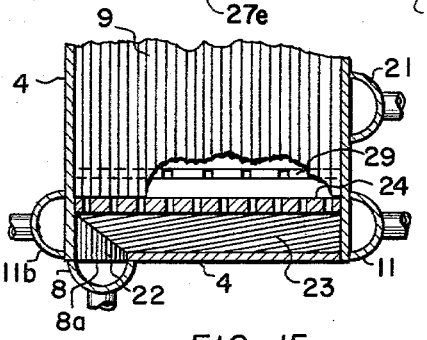
FIG. 15

PLATE TYPE HEAT EXCHANGER WITH BAR MEANS FOR FLOW CONTROL AND STRUCTURAL SUPPORT

DESCRIPTION

TECHNICAL FIELD

This apparatus is concerned generally with a plate type heat exchanger in which liquid and vaporous phases of a heat exchange fluid are separately distributed, then combined to flow therethrough in heat exchange relationship with a feed fluid, and in particular, concerns the use of slotted metallic bars to control the rate of flow of one of the heat exchange fluids, and to provide substantial structural support for the plates of the heat exchanger.

BACKGROUND ART

In certain manufacturing processes, it is necessary to provide heat transfer between combined liquid and vaporous phases of a heat exchange fluid, and a feed fluid. For efficient operation and optimum heat transfer, the liquid and vapor should be uniformly distributed across the width of the heat exchanger prior to passing in heat exchange relationship with the feed fluid. Apparatus and a method for accomplishing this are disclosed in U.S. Pat. No. 3,559,722, assigned to the same assignee as the present invention.

In the '722 patent, transfer passage means provide fluid communication between the liquid and vapor passages and are disclosed as a slot in the metallic plates separating the liquid and vapor, extending the width of the heat exchanger. Since the heat exchanger structure is weakened by the slot in the plates, a corrugated sheet metal fin is shown "bridging" the slot to support the metallic plates on each side of the slot. The corrugations of the "bridging" fin are aligned parallel to the longitudinal axis of the heat exchanger and do not significantly inhibit fluid flow through the transfer passage means. Upstream of the "bridging" fin, another rectangular-shaped corrugated fin structure is disposed with the corrugations extending across the fluid flow path, so that the fluid is forced to flow through perforations in the fin walls, in the "hard" way. These "hard way" fins improve the lateral distribution of the fluid in the passages wherein they are disposed and partially restrict fluid flow through the heat exchanger in accordance with design criteria.

An alternative prior art design uses sparge tubes (conduit having a plurality of perforations therein) to distribute one of the fluid phases across the width of the heat exchanger prior to admitting it into flow passages in which the other heat exchange fluid has been distributed. An example of this type heat exchanger is disclosed in U.S. Pat. No. 3,895,676. The sparge tube heat exchanger typically is used for moderate two phase fluid flow rate applications at low pressure, e.g., less than 250 psi, although it can be built to operate at higher pressures, in excess of 700 psi. By comparison, the maximum pressure rating of a typical heat exchanger built according to the '722 patent is about 525 psi. The "bridging" fins and "hard way" fins used in the split parting plate heat exchanger limit the structural strength and subsequently, the pressure rating of that type heat exchanger.

Heat exchangers of the type cited operate efficiently only at specific mass flow ratios of the liquid and vaporous phases. Although such heat exchangers may operate properly when the flow rates of both the liquid and vapor change by the same percentage, they are generally inefficient in coping with significant changes in the ratio of liquid flow to vapor flow. For example, a significant increase in the liquid flow may flood or "drown" the vapor distribution means, thereby preventing proper distribution of the vapor across the heat exchanger prior to mixing with the liquid. Heat exchangers of prior art design have not provided means to meet the requirements of processes in which the ratio of liquid to vapor flow may change substantially, as for example during start-up and shut-down, or during operation under stable temperature conditions which prevent the mass flow ratio from reaching equilibrium. The ratio of liquid to vapor flow cannot be controlled over more than a very narrow range by means external to the heat exchanger without interfering with the efficient distribution and mixing of the liquid and vapor fluids internal to the heat exchanger.

In consideration of the above problems, the present invention provides the means to extend the pressure rating of a split plate-type heat exchanger to a level over 700 psi, and the means to control the ratio of liquid to vapor flow through the heat exchanger over a much wider range than previously available.

DISCLOSURE OF THE INVENTION

The subject invention is a plate-type heat exchanger in which metallic plates of similar shape, length, and width are arranged in spaced apart, parallel relationship along a common longitudinal axis. The plates are sealingly connected along their periphery by first sealing means, which together with the plates define: shallow elongated passages between the plates; first inlet means for admitting one of the vaporous and liquid phase heat exchange fluids into first ones of said passages; second inlet means for admitting the other of said heat exchange fluids into second ones of the passages, each of which are adjacent at least one of the first passages; and outlet means for conveying the liquid and vapor, in combination, out of the heat exchanger. The first and second inlet means are adjacent one end of the heat exchanger and the outlet means are adjacent the other end. Second sealing means divide the second passages into other heat exchange fluid passages on the side which is connected to the second inlet means, and feed fluid passages on the other side.

First and second distribution means are operative to separately distribute the two phases of the heat exchange fluids uniformly across the width of the heat exchanger in the first and in the other heat exchange fluid passages, respectively. Crossover means disposed in and through the metallic plates separating the first passages from the other heat exchange fluid passages convey the other heat exchange fluid therethrough so that it combines with the one heat exchange fluid flowing in the first passages. The crossover means are disposed transversely across the longitudinal axis of the heat exchanger, on the same side of the second sealing means as the second inlet means.

Bar means are disposed within the other heat exchange fluid passages, parallel to and abridging the crossover means and providing substantial support for the metallic plates in that part of the heat exchanger. The bar means include means connecting the crossover means in fluid communication with the other heat exchange fluid passages; said means being further defined as slots of predetermined width, depth, and/or spacing to control the flow of the other heat exchange fluid through the crossover means.

Feed fluid inlet means admit the feed fluid into the feed fluid passages in heat exchange relationship with the combined liquid and vaporous heat exchange fluids flowing in the first passages, and feed fluid outlet means convey the feed fluid out of the heat exchanger.

In one embodiment, metering control means, including rods with flat sides disposed in a cylindrical bore in each of the bar means, are operative to provide for adjustment of the rate of flow of the other heat exchange fluid through the crossover means.

In another embodiment, the second inlet means are divided for selectively admitting the other heat exchange fluid only into first ones of the other heat exchange fluid passages as a first condition of flow, only into second ones of the other heat exchange fluid passages as a second condition of flow, and into both as a third condition of flow. This permits control of the other heat exchange fluid flow rate in discrete steps.

An object of this invention is to provide a heat exchanger capable of efficient heat transfer between a two-phase liquid and vaporous heat exchange fluid and a feed fluid at relatively high operating pressures (substantially in excess of 525 psi).

Another object of this invention is to provide a simplified means of restricting the rate of flow of one of the heat exchange fluids through a plate-type heat exchanger, said means also being operative to provide substantial support to the metallic plates, where they are split to allow fluid communication between the passages in which the two heat exchange fluids are distributed.

A further object of this invention is to selectively and efficiently operate such a plate-type heat exchanger at one of three conditions of flow of one of the liquid and vaporous fluids through the heat exchanger, to provide thereby a wider range of mass flow ratio of liquid to vapor without detriment to the efficient operation of the heat exchanger.

Still a further object of this invention is to provide means to adjust the rate of flow of one of the liquid and vaporous fluids over a continuous range so that the ratio of mass flow of the two fluids may be altered to meet changing requirements of certain processes, without detriment to the efficient operation of the heat exchanger.

These and other objects of the present invention will become apparent from the following description of the preferred embodiments and by reference to the accompanying drawings.

BRIEF DESCRIPTION OF THE DRAWINGS

FIG. 1 is a front elevation of a plate-type heat exchanger showing the general flow paths of the fluids therein for several embodiments of the invention.

FIG. 2 is a side elevation of the heat exchanger of FIG. 1.

FIG. 3 is a section taken at line 3—3 of FIG. 1 showing an embodiment of the invention.

FIG. 3A is an enlarged view of a portion of FIG. 3 showing the flow of fluid around the slotted metallic bar.

FIG. 4 is a section taken at line 3—3 of FIG. 1 showing another embodiment of the invention.

FIG. 5 is a section taken at line 5—5 of FIG. 2.

FIG. 6 is a section taken at line 6—6 of FIG. 3.

FIG. 7 is a section taken at line 7—7 of FIG. 4.

FIG. 10 shows a partially cut-away and enlarged side elevation view of an embodiment of the invention, specifically that part wherein metering control means are included.

FIGS. 10A and 10B show details of an end view of the two embodiments of the metering control means of FIG. 10, and the relative extreme positions of the rods included therein.

FIG. 11 is a front elevation view of a plate-type heat exchanger showing the flow paths of the fluids therein in the embodiments in which there is provision for tandem liquid flow.

FIG. 12 is a section taken at line 12—12 of FIG. 11, showing an embodiment of the invention.

FIG. 13 is a section taken at line 12—12 of FIG. 11, showing another embodiment of the invention.

FIG. 14 shows a section taken at line 14—14 of FIG. 12.

FIG. 15 is a section taken at line 15—15 of FIG. 12.

FIG. 16 is a section taken at line 16—16 of FIG. 12.

FIG. 17 shows the distinguishing relative dimensions of one embodiment of the metallic bars which are included in the invention.

DESCRIPTION OF THE PREFERRED EMBODIMENTS

Figure 8:
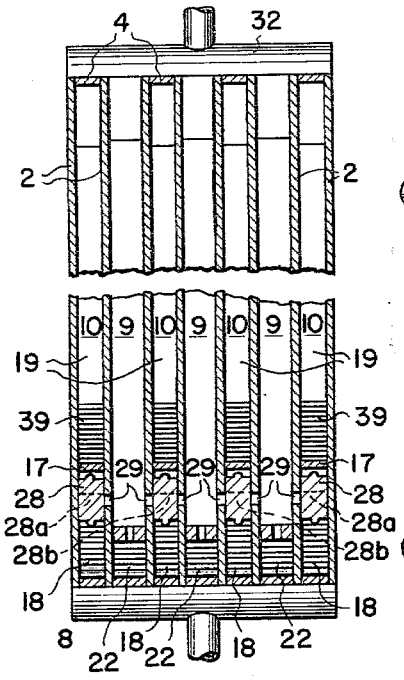
FIG. 8 is a section taken at line 3—3 of FIG. 1 showing another embodiment of the invention.
Figure 8A:
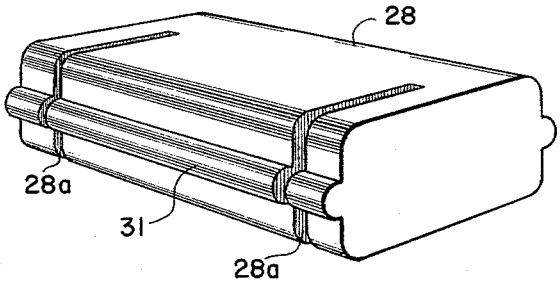
FIGS. 8A and 8B show the relatively different spacing and dimensions of slots formed in two metallic bars used in the heat exchanger of FIG. 8.
Figure 8B:
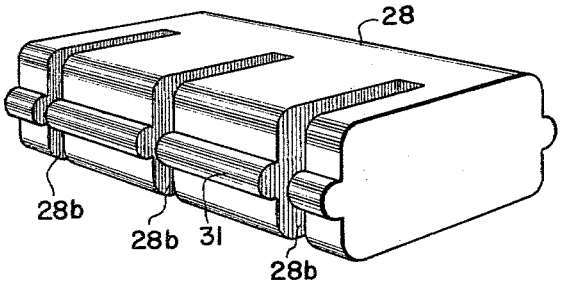

With reference to FIG. 1, the pattern of flow through the heat exchanger of a liquid and vaporous heat exchange fluid, and of a feed fluid are generally shown for a first group of embodiments of the invention. The flow path of the liquid heat exchange fluid is represented by solid lines; the flow path of the vaporous heat exchange fluid is represented by dashed lines; and the flow path of the feed fluid is represented by alternating dot and dash lines. Throughout the following explanation, for purposes of convenience, one of the heat exchange fluids will be referred to simply as vapor, and the other heat exchange fluid as liquid. It should be understood, however, that the flow path of liquid and vapor through the heat exchanger may be interchanged within the scope of the claims.

As shown clearly in FIG. 2, the heat exchanger 1*a* is constructed of flat metallic plates, of similar shape, length, and width, spaced apart in parallel relationship and sealed at the edges by first sealing means comprising sealing bars 4, connecting the plates together at their perimeters.

Attention is now directed to FIGS. 3–7 for an explanation of two different embodiments of the present invention. First inlet means comprise first inlet 8*a* and first header 8. Metallic plates 2 and sealing bars 4 define first inlet 8*a* which provides an opening into the heat exchanger for a vapor to flow from first inlet header 8 which is sealingly attached to the heat exchanger in surrounding relationship to the first inlet 8*a*. The vapor flows through first inlet 8*a* into first passages 9 and is uniformly distributed across the width of the heat exchanger by first distribution means comprising a small triangular shaped corrugated metallic sheet fin material 22, a trapezoidal shaped corrugated sheet fin material 23, and an orifice metering strip 24. The flow of the vapor is generally directed parallel to the crests of the corrugated metallic sheet fin materials 22 and 23 across the width of the heat exchanger. Orifice metering strip 24 consists of bar stock extending across the width of the heat exchanger, through which a plurality of perforations of specific number and diameter are formed to encourage the flow of the vapor through the heat exchanger in a well distributed manner, and to provide for increased vapor velocity as the vapor exits these perforations. The resultant high vapor velocity reduces flooding of the first distribution means by the liquid as will be explained hereinbelow.

The second passages 19 are divided by second sealing means comprising sealing bars 17 into liquid passages 18, and feed fluid passages 10. Liquid enters the heat exchanger through second inlet means comprising second inlet 11*a*, sealingly enclosed by second inlet header 11. The liquid entering second inlet 11*a* is uniformly distributed across the width of the heat exchanger in liquid passages 18 by two triangular shaped corrugated metallic sheet fin structures 25 and 26. Immediately downstream of fin material 26 are bar means, comprising in one embodiment, slotted metallic bars 27 and in another embodiment, slotted metallic bars 28. Slotted metallic bars 27 and 28 extend substantially across the width of the heat exchanger, as shown in FIGS. 6 and 7, respectively.

Referring now to FIGS. 3, 3A, and 4, slots 27*a* are formed across a first and second surface of slotted metallic bars 27, in a direction generally parallel to the longitudinal axis of metallic plates 2, and in overlying relationship with crossover means comprising slots 29 formed in metallic plates 2 which separate the first passages 9 from the liquid passages 18. As shown in FIG. 3A, the liquid may flow in slots 27*a* formed on both the first and second surfaces of slotted metallic bars 27, thereafter combining to flow through slots 29 into first passages 9, where the liquid combines with the vapor. In the embodiment shown in FIG. 4, slots 28*a* are formed in a third surface of the metallic bars 28, extending generally between the first and second surfaces, and coincide at least in part in overlying relationship with the crossover means defined by slots 29. Liquid flows through slots 28*a* and thereafter through slots 29 to mix with the vapor in first passages 9.

Slotted metallic bars 27 or 28 provide two important functions as will be herein explained. The crossover means defined by slots 29 in metallic plates 2 substantially weaken the internal structure of the heat exchanger. In the prior art, a corrugated "bridging" fin is used in overlying relationship to the slot to provide the necessary structural continuity for the metallic plates. Since the corrugated "bridging" fins, being made of sheet metal, are incapable of providing adequate support to metallic plates 2 at relatively high operating pressures, the metallic slotted bars 27 or 28 are provided in this invention in part to eliminate the "bridging" fin and thereby increase the structural strength of the heat exchanger. The increase in structural strength results because of the greater cross sectional area provided by the metallic slotted bars 27 and 28 for supporting the metallic plates 2 at each side of the crossover means, slots 29.

It is important to distinguish over the bridging fins provided in the prior art, with respect to this function. As a practical matter, with the current technology and machinery used for manufacturing corrugated metallic sheet fin structures, the maximum fin density available can only provide a bridging fin with a ratio of material to open space of approximately 0.4, measured transversely to the axis of the corrugations. By comparison, the slotted metallic bars 27 or 28 of the present invention are typically formed with a ratio of 0.95 material to open space, thereby providing both greater surface area to which the metallic plates 2 may be brazed and substantially greater support to those plates.

In addition, slotted metallic bars 27 or 28 serve a second function, by restricting the flow of the liquid through the crossover means in a manner determined by the width, depth, and/or spacing of the slots formed in the bars. The slotted metallic bars 27 or 28 therefore also eliminate the "hard way" fins which are used to restrict the flow of liquid in the prior art.

The liquid which flows through slots 28 mixes with the vapor in first passages 9, and flows through the heat exchanger in a direction parallel to the crests of corrugated metallic sheet fins 9*a* disposed therein. Corrugated metallic sheet fin structures 23*a* and 22*a* operate to direct the flow of the combined liquid and vapor toward outlet means comprising outlet 32*a*, and outlet manifold 32, sealingly attached in surrounding relationship around outlet 32*a*. As it passes through the heat exchanger, the liquid typically is substantially evaporated such that the fluid exiting through outlet 32*a* is essentially vaporous.

Figure 9:
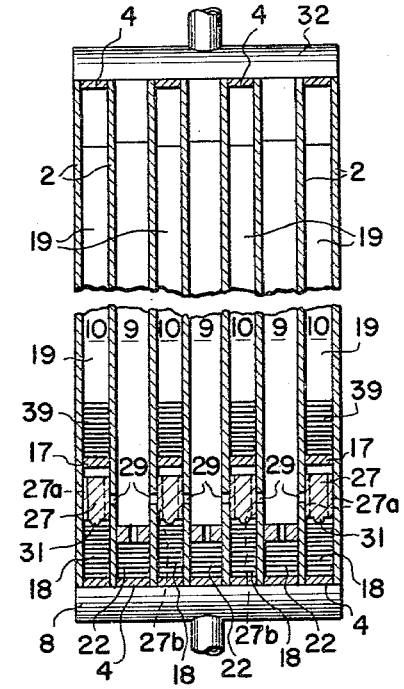
FIG. 9 is a section taken at line 3—3 of FIG. 1 showing still another embodiment of the invention.
Figure 9A:
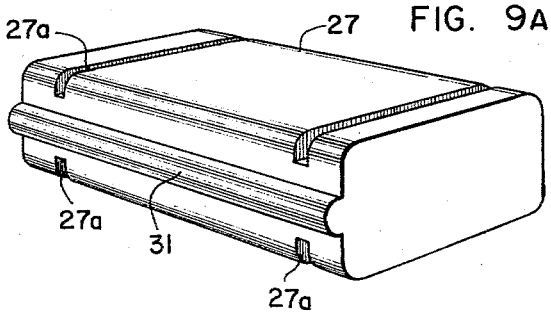
FIGS. 9A and 9B show the relatively different spacing and dimensions of slots formed in the metallic bars used in the heat exchanger of FIG. 9.
Figure 9B:
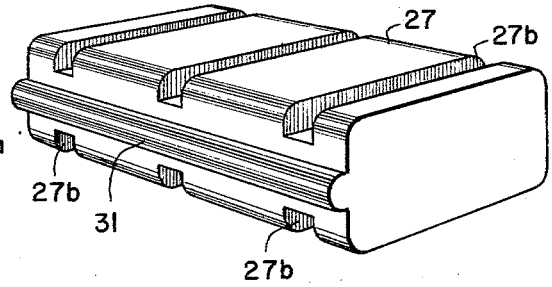

The feed fluid enters the heat exchanger from feed fluid inlet means comprising inlet 20*a* and header 20 which is sealingly attached in surrounding relationship around feed fluid inlet 20*a*. The feed fluid is thereafter distributed by triangular-shaped corrugated sheet fin structures 40*a* and 39*a* so that it may uniformly flow through the feed fluid passages 10 in heat exchange relationship with the combined vapor and liquid, to be collected by similarly shaped corrugated metallic sheet fin structures 40 and 39. The feed fluid passes out of the heat exchanger through feed fluid outlet means comprising feed fluid outlet 21*a* and feed fluid manifold 21 which is sealingly attached in surrounding relationship around feed fluid outlet 21*a*. Heat transfer between the feed fluid and the combined liquid and vapor heat exchange fluids occur in the heat exchanger in that area contiguous to the feed fluid passages Turning now to FIGS. 8 and 9, two additional embodiments are shown in which the crossover means defined by slots 29 are disposed in both metallic plates 2 which define each of the first passages 9. In both of these embodiments, liquid from liquid passages 18 flow through slots 27*a* and *b*, or 28*a* and *b*, and through the crossover means defined by slots 29 which are adjacent thereto. Since the liquid passages 18 which are located adjacent the exterior metallic plates 2 of the heat exchanger only supply liquid to one first passage 9 as compared to the other liquid passages 18 which are located on the interior portions of the heat exchanger and which each supply liquid to two first passages 9, the slots 27*a* or 28*a* are of wider spacing and/or narrower width than the slots 27*b* or 28*b*, to provide for substantially less flow of liquid therethrough, at the same pressure drop. FIGS. 8A, 8B, 9A, and 9B, show the relative spacing of slots 28*a* and 28*b*, and slots 27*a* and 27*b*. It should further be clear from these representations that slots formed in metallic bars 27 or 28 of different depth, width, and/or spacing are therefore operative to restrict the rate of flow of one of the heat exchange fluids through the heat exchanger to a predetermined level, in proportion to these dimensional parameters.

The width of slots 29 which define crossover means in the metallic plates 2 must be maintained to an acceptable tolerance during construction of the heat exchanger. This is typically accomplished by inserting a spacer strip at each end of the slots 29 during lay-up of the metallic plates 2.

A rounded spacer rib 31 is shown disposed on the side of the slotted metallic bars 27 adjacent metallic fin structures 26, and on this and the opposite side of slotted metallic bars 28, for the purpose of maintaining spaced apart relationship between the body of these bars and the corrugated metallic fin structures 26, and sealing bars 17.

With regard to the slotted metallic bars 28, it will be apparent that sealing bars 17 are not required for sealingly separating the liquid from the feed fluid. The metallic bars 28 provide this additional function, by being brazed to the metallic plates 2 in that portion which is not slotted. Sealing bars 17 provide a second seal.

Referring now to FIGS. 10, 10A, and 10B, an embodiment of this invention is shown in which the slotted metallic bars 27 include metering control means, comprising a cylindrical bore 34 which extends substantially the entire length of the slotted bars 27, and intersects at least in part the slots 27*a* which are formed therein. A rod 34*a* and 34*b* having one or two flat sides 35, and a diameter only slightly less than the diameter of bore 34, is inserted therein such that it may be rotated within bore 34 through at least an angle of 90°. The rods 34*a* or 34*b* extends slightly beyond the first sealing means on the edge of the heat exchanger which is opposite the edge in which second inlet means 11*a* and feed fluid inlet means 21*a* are disposed, and are connected together on that end by linkage means comprising individual connecting links 37 and a main linkage 36. The individual connecting links 37 are appropriately attached to the ends of rods 34*a* or 34*b*, as for example by self-tapping metal screws 39, so that if connecting link 37 is moved in an arc around the center of screw 39, the rods 34*a* or 34*b* are caused to revolve around their longitudinal axis. The individual connecting links 37 are attached to the main linkage 36 by a pivotal connection 33, so that as the main linkage 36 is moved from side to side the rods 34*a* or 34*b* are caused to rotate about an angle of approximately 90°. FIGS. 10A and 10B show the extreme positions which the rods 34*a* or 34*b* may assume at the extremes of this 90° angle of rotation.

It should be apparent that as rods 34*a* or 34*b* rotate, they offer minimum flow impedance when the flat surfaces 34 are parallel with the metallic plates 2, and maximum flow impedance when the flat surfaces 35 are at right angles to the metallic plates 2. The flow of liquid through crossover means defined by slots 29 is therefore determined over at least a limited range by the rotational position of the rods 34*a* or 34*b*, and by the dimension and spacing of the slots 27*a* in the slotted metallic bars 27. The embodiment shown in FIG. 10B, wherein slots 27*a* are formed on only the first surface of slotted metallic bars 27, is disposed in liquid passages 18 which are adjacent to exterior metallic plates 2 of the heat exchanger; and the embodiment shown in FIG. 10A, wherein slots 27*a* are formed on the first and second surfaces of the slotted metallic bars 27, are disposed in interior liquid passages 18 wherein crossover means defined by slots 29 are adjacent the first and second surfaces of the slotted metallic bars 27.

It is anticipated that the rods 34*a* and 34*b* would be inserted into the heat exchanger after it is constructed and brazed, through the cylindrical bores 34, and sealed with "O" rings disposed near the end adjacent the individual connecting links 37. The rods 34*a* or 34*b* would be cylindrical at each end where they extend through sealing bars 4, the flat part of the rods 34*a* or 34*b* being limited to the section between opposite sealing bars 4. Leakage between adjacent slots 27*a* along each cylindrical bore 34 is not considered to be of concern because of the common conditions of pressure and flow which exist at each slot therein.

Referring now to FIG. 11, another embodiment of the invention is shown in which liquid is admitted into a heat exchanger 1*b* separately through second inlet means divided for selectively admitting a liquid A and a liquid B in order to provide three conditions of liquid flow throuh the heat exchanger. The flow path of liquid A through the heat exchanger 1*b* is generally noted by solid lines having cross hatches thereon, and the flow of other fluids therethrough is noted as before in FIG. 1. In these embodiments of the invention, liquid A is controlled by valve 41 and enters the heat exchanger 1*b* from second inlet means comprising second inlet 11*c* and second inlet header 11*b*, which is sealingly attached in surrounding relationship around second inlet 11*c*. Liquid A flows into liquid passages 18*a* and is distributed uniformly across the width of the heat exchanger by triangular shaped corrugated metallic sheet fin structures 25*b* and 26*b*. Liquid B is controlled by valve 42 and otherwise flows through the heat exchanger in a fashion analogous to liquid A as already explained.

With reference to FIGS. 14, 15, and 16, one embodiment of the invention is shown utilizing slotted metallic bars 28 having slots 28*a* or 28*b* formed therein to restrict the flow of liquid A and liquid B respectively, through crossover means defined by slots 29 in metallic sheets 2. Slotted metallic bars 28 with slots 28*a* are disposed in liquid passages 18*a* to restrict the flow of liquid A, whereas slotted metallic bars 28 having slots 28*b* formed therein are disposed in liquid passages 18 to restrict the flow of liquid B through crossover means defined by slots 29.

Referring to FIG. 12, from left to right are shown in sequence distribution means for the liquid A, the vapor, the liquid B the vapor, the liquid A, the vapor, and the liquid B. Althougn slotted metallic bars 28 are shown in the embodiment of FIG. 12, slotted metallic bars 27 are equally applicable as is shown in FIG. 13. Referring to FIG. 12, it should be apparent that liquid A is restricted in flow by the slots 28*a*, and liquid B is restricted by slots 28*b*; likewise, as shown in FIG. 13, the flow of liquid A is restricted by slots 27*b* and the flow of liquid B is restricted by slots 27*c*. It is thus possible to operate either embodiment of the invention in three different conditions of liquid flow, i.e., one in which only liquid A is admitted as a first condition of flow of liquid through the heat exchanger; one in which only liquid B is admitted as a second condition of flow of liquid through the heat exchanger; or one in which both liquid A and liquid B are together admitted as a third condition of flow of liquid through the heat exchanger. As a specific example, the mass flow ratio of liquid to vapor might be 1:3 for liquid A only, 2:3 for liquid B only, and 1:1 for both liquid A and liquid B.

It is also anticipated that liquid A and liquid B could be derived from separate sources, and that their flow through the heat exchanger would be determined by the relative dimension and/or spacing of slots disposed in the slotted metallic bars 27 and 28, thereby providing the same or different rate of flow of the liquids A and B through the heat exchanger in accord with specific process requirements. By providing for different conditions of flow of liquid A or liquid B through the heat exchanger, the present invention allows the ratio of liquid to vapor to be changed in discrete steps by selection of the second inlet means 11*a* or 11*c* which are active to admit the liquid into the heat exchanger. In other respects these embodiments of the invention operate as previously described.

It will be apparent that the width of the crossover means defined by slots 29 also affects the relative rate of flow of liquids A or B through the heat exchanger. In consideration of determining a minimum width, experiments have shown that brazing filler material will not fill-in a slot 29, which is at least 0.030" in width. The actual lower limit is probably slightly less than this. In practice, the width of slot 29 will not be less than 0.045" and typically is closer to 0.090". It has been found that a relatively wide slot 29 improves the lateral distribution of the liquid as it flows through the slot 29 and into the first passage 9. This places a limit on the flow restriction which may be provided by slots 29 without reducing the optimum distribution of liquid prior to mixing with the vapor. An unexpected consequence of the lateral distribution of liquid in slots 29 is that the rate of flow of liquid through an orifice having a flow area equal to the product of the width of slot 29 and the width of a slot in the metallic bars 27 or 28 is less than the rate of flow through that combination of slot in the metallic bars and the slot 29, other conditions being equal. The flow is greater than through an orifice because the slots in the metallic bars 27 or 28 and the slot 29 are in different geometric planes, thereby allowing the fluid to disperse through the rectangular openings formed by the adjacent overlying surfaces of the slotted metallic bar 27 or 28, and the slot 29. The rate of flow is thus best controlled by the dimensions of the slots in metallic bar 27 or 28, with enhanced distribution provided by slots 29.

In a typical application for this invention the pressure drop across the slot in the bars 27 or 28 and the slot 29 would fall in the range of 1–3 psi. The slot 29 might be 0.090" wide; the slots in the bars 27 or 28, 0.030" to 0.1" wide and spaced according to the maximum volume of flow required, typically at least 1" apart. It has been observed that a slot 29 which is 0.090" in width will easily provide substantially uniform lateral dispersion for liquid flowing through slotted bars 28 with the slots therein spaced at 2" intervals. It should be apparent that there is a cost consideration in forming slots in the metallic bars 27 or 28, and that the required volume of fluid flow will dictate their width and frequency.

Referring now to FIG. 17, slotted metallic bar 27 is shown with slots 27*d* and 27*e* on alternate sides, at a spacing "S" and a depth "D", the thickness of the bar being denoted by "T". This representation of the slotted metallic bar 27 is intended to show that within the scope of the claims, this embodiment of slotted metallic bar 27 is significantly different than the "bridging" fin of the prior art. In the prior art, the bridging fin is formed by folding corrugations in a metallic sheet of substantially uniform thickness. From this fact, it necessarily follows that the spacing between the corrugations of the bridging fin would be substantially the same as the thickness of the metallic sheet from which the corrugations were folded. As claimed, however, slotted metallic bar 27 shown in FIG. 17 significantly differs from the "bridging" fin in that slots 27*e* and 27*d* are of spacing "S" which is not equal to the difference between the thickness of the slotted metallic bar 27 and the depth of the slots 27*e* or 27*d*. In other words, the slotted metallic bar 27 could not be formed from uniform thickness metallic sheets, within the scope of the claims. Furthermore, as explained above, the corrugated metallic sheet bridging fin cannot be made with the required supportive strength.

It is anticipated that the various embodiments of this invention described herein would be constructed of aluminum sheets and extrusions or of other material having good heat transfer characteristics. The techniques of constructing a heat exchanger of this type using brazed aluminum are well known in the art and include assembling the plates, extruded bars, and corrugated metallic sheet fin material in a fixture, and brazing in a salt bath or furnace.

The orifice metering strips 24 disposed in the first passage 9 are used in these embodiments in place of "hard way" fins to enable the heat exchanger so constructed to operate at high pressures. It is also anticipated that if the subject heat exchanger were intended to be operated at lower pressures, for economic reasons, it would be desirable to replace the orifice metering strips 24 with "hard way" fin structures. The purpose of the orifice metering strips 24 or an equivalent "hard way" fin structure is to provide openings or perforations through which the vapor will flow at relatively high velocity such that the liquid entering into the first passages 9 and mixing with the vapor therein is prevented from flooding the first distribution means by which the vapor is distributed uniformly across the width of the heat exchanger.

It will be apparent to one skilled in the art, that the heat exchanger could be operated with the feed fluid flowing in opposite directions such that the feed fluid enters adjacent the same end through which the vapor and liquid heat exchange fluids enter, and exits the heat exchanger adjacent the same end through which the vapor and liquid heat exchange fluids exit.

While the invention has been described with respect to preferred embodiments, it is to be understood that modifications thereto will be apparent to those skilled in the art within the scope of the invention, as defined in the claims which follow.

I claim:

1. A plate type heat exchanger comprising
   a. a plurality of generally planar metallic plates of similar shape, length, and width, arranged in spaced apart, parallel relationship along a common longitudinal axis;
   b. first sealing bars for sealingly connecting said metallic plates along the periphery of their facing surfaces, and in conjunction with said metallic plates, defining
      i. a plurality of shallow, elongated passages between adjacent facing surfaces of said metallic plates;
      ii. first inlet means for admitting a first fluid into first ones of said passages, said first inlet means being disposed adjacent one end of the heat exchanger, and said first passages being non-adjacent to each other;

iii. second inlet means for admitting a second fluid into second ones of said passages, said second inlet means also being disposed adjacent said one end of the heat exchanger, and each of said second passages being adjacent at least one of said first passages, separated by said metallic plates;

iv. outlet means for conveying said first and second fluids in combination out of the heat exchanger, said outlet means being adjacent the other end of the heat exchanger;

c. second sealing bars disposed in said second passages into which said second fluid is admitted and extending between the first sealing bars at opposite edges of said metallic plates, thereby dividing each of said second passages into a second fluid passage connected to the second inlet means on one side and a third fluid passage on the other side of said second sealing bars for conveying a third fluid;

d. first corrugated metallic sheet fins for distributing said first and second fluids substantially uniformly across the width of the heat exchanger;

e. second corrugated metallic sheet fins for distributing said third fluid substantially uniformly across the width of the heat exchanger in said third fluid passages;

f. crossover passages disposed in and passing through the metallic plates separating said first passages conveying said first fluid from said second fluid passages which are adjacent thereto, said crossover passages providing fluid communication between said first passages and said second fluid passages, whereby said second fluid may flow into said first passages, and combine with said first fluid therein, following separate distribution thereof by the first corrugated metallic sheet fins;

g. metallic bars disposed within said second fluid passages generally parallel to and abridging the crossover passages along their length, such that said metallic bars provide substantial support for the metallic plates in that part of the heat exchanger in which the crossover passages are disposed; said metallic bars including a plurality of metering passages which provide fluid communication between said second fluid passages and said crossover passages, and which are operative to restrict the flow of said second fluid through said crossover passages prior to said second fluid mixing with said first fluid in the first passages;

h. third fluid inlet means for admitting a third fluid into the third fluid passages in heat exchange relationship with the combined first and second fluids flowing in said first passages; and i. third fluid outlet means for conveying the third fluid out of the heat exchanger.

2. A plate type heat exchanger comprising a. a plurality of generally planar metallic plates of similar shape, length, and width, arranged in spaced apart, parallel relationship along a common longitudinal axis;

b. first sealing means for sealingly connecting said metallic plates along the periphery of their facing surfaces, and in conjunction with said metallic plates, defining i. a plurality of shallow, elongated passages between adjacent facing surfaces of said metallic plates;

ii. first inlet means for admitting one of a vaporous phase and a liquid phase heat exchange fluids into first ones of said passages, said first inlet means being disposed adjacent one end of the heat exchanger, and said first passages being non-adjacent to each other;

iii. second inlet means for admitting the other of said vaporous phase and said liquid phase heat exchange fluids into second ones of said passages, said inlet means also being disposed adjacent said one end of the heat exchanger, and each of said second passages being adjacent at least one of said first passages, separated by said metallic plates;

iv. outlet means for conveying said vaporous phase and said liquid phase heat exchange fluids in combination out of the heat exchanger, said outlet means being adjacent the other end of the heat exchanger;

c. second sealing means disposed transversely across the longitudinal axis of said metallic plates in said second passages into which said other heat exchange fluid is admitted, said second sealing means extending between the first sealing means at opposite edges of said metallic plates, thereby dividing each of said second passages into an other heat exchange fluid passage connected to the second inlet means on one side and a feed fluid passage on the other side of said second sealing means;

d. first distribution means for distributing said one heat exchange fluid substantially uniformly across the width of the heat exchanger in said first passages;

e. second distribution means for distributing said other heat exchange fluid substantially uniformly across the width of the heat exchanger in said other heat exchange fluid passages;

f. crossover means disposed in and passing through the metallic plates separating said first passages conveying said one heat exchange fluid from said other heat exchange fluid passages which are adjacent thereto, said crossover means being disposed transversely across the longitudinal axis of the metallic plates such that the second inlet means and the crossover means are on the same side of the second sealing means, whereby said other heat exchange fluid may flow into said first passages, and combine with said one heat exchange fluid therein, following distribution thereof by the second and first distribution means, respectively;

g. bar means disposed within said other heat exchange fluid passages generally parallel to and abridging the crossover means along their length, such that said bar means provide substantial support for the metallic plates in that part of the heat exchanger in which the crossover means are disposed and further, by inclusion of means connecting said other heat exchange fluid in fluid communication with said crossover means, are operative to limit and control the flow of said other heat exchange fluid through said crossover means prior to said other heat exchange fluid mixing with said one heat exchange fluid in the first passages;

h. feed fluid inlet means for admitting a feed fluid into the feed fluid passages in heat exchange relationship with the combined liquid and vaporous heat exchange fluids flowing in said first passages; and i. feed fluid outlet means for conveying the feed fluid out of the heat exchanger.

3. The heat exchanger of claim 2 wherein said bar means include elongated metallic bars having a first surface and a second surface generally parallel to and in supporting relationship with said metallic plates defining the other heat exchange fluid passages, and a third surface exposed to said other heat exchange fluid passage; said connecting means formed in the bar means including a plurality of slots formed in said metallic bars, said slots being of predetermined width, depth, and spacing and operative to provide communication for, and to control the flow of said other heat exchange fluid between said other heat exchange passages and said crossover means.

4. The heat exchanger of claim 3 wherein said slots are formed in said third surface of the metallic bars extending generally between said first and second surfaces and generally in the direction of the longitudinal axis of the metallic plates, said slots coinciding at least in part in overlying relationship with said crossover means.

5. The heat exchanger of claim 3 wherein said crossover means are disposed in the metallic plates immediately adjacent one of said first or second surfaces and wherein slots are formed in said one of the first and second surfaces of the metallic bars, at least in part in overlying relationship with said crossover means, and extending generally in the direction of the longitudinal axis of the metallic plates.

6. The heat exchanger of claim 3 wherein said crossover means are disposed in the metallic plates immediately adjacent said first and second surfaces and wherein said slots are formed in both said first and second surfaces of the metallic bars, at least in part in overlying relationship with said crossover means, and extending generally in the direction of the longitudinal axis of the metallic plates.

7. The heat exchanger of claim 6 wherein the slots formed in the first surface are not directly opposite the slots formed in the second surface and wherein the volume of open space defined by the slots is less than the volume of metal in the metallic bars.

8. The heat exchanger of claim 4, 5, or 6 wherein the spacing between said slots in each of the metallic bars is substantially greater than the width of said slots.

9. The heat exchanger of claim 4, 5, or 6 wherein said second inlet means are divided for selectively admitting said other heat exchange fluid only into first ones of said other heat exchange fluid passages as a first condition of flow, only into second ones of said other heat exchange fluid passages as a second condition of flow, or into both said first and second other heat exchange fluid passages as a third condition of flow, such that flow of the other heat exchange fluid is thereby controlled in discrete steps.

10. The heat exchanger of claim 4, 5, or 6 wherein said other heat exchange fluid is supplied to said second inlet means at a first and at a second available rate of flow, and wherein said second inlet means are divided for admitting said other heat exchange fluid at the first rate of flow into first ones of said other heat exchange fluid passages, separate and apart from said other heat exchange fluid which is at the second rate of flow and which is admitted thereby into second ones of said other heat exchange fluid passages, such that said first of the other heat exchange fluid passages differ from said second of the other heat exchange fluid passages by the rate at which the other heat exchange fluid is able to flow through the slotted bar means disposed therein.

11. The heat exchanger of claim 10 wherein said slots in the metallic bars disposed within said first of the other heat exchange fluid passages conveying said other heat exchange fluid at the first rate of flow are of different width, spacing, and/or depth than the slots in the metallic bars disposed within said second of the other heat exchange fluid passages conveying said other heat exchange fluid which is at said second rate of flow.

12. The heat exchanger of claim 3 wherein said first and second distributor means include corrugated metallic sheets having the axis of the corrugations aligned such that fluid flow is thereby generally directed across the width of the heat exchanger.

13. The heat exchanger of claim 12 wherein said first distribution means include metal strips provided with orifices of appropriate dimension, said metal strips extending across the width of the heat exchanger and disposed upstream of the said crossover means in said first passages, with the axis of the orifices aligned generally parallel to the longitudinal axis of the heat exchanger such that the orifices partially restrict the flow of said one heat exchange fluid therethrough.

14. The heat exchanger of claim 3 wherein said one heat exchange fluid is in the vaporous phase, and said other heat exchange fluid is in the liquid phase.

15. The heat exchanger of claim 3 wherein said crossover means define slotted opening penetrating through the metallic plates in which they are disposed.

16. The heat exchanger of claim 15 wherein said crossover means extend from the first sealing means at one side of the heat exchanger to the first sealing means on the other side of said heat exchanger.

17. The heat exchanger of claim 3 wherein said bar means include metering control means for adjusting the rate of flow of said other heat exchange fluid through said crossover means, over at least a limited range.

18. The heat exchanger of claim 17 wherein said metering control means include a. a generally cylindrical bore in each of the bar means, extending substantially through the length of the metallic bars, generally parallel to their longitudinal axis, and of sufficient diameter to intersect, at least in part, the slots disposed in the metallic bars;

b. a plurality of generally cylindrical metal rods, each having a diameter slightly less than the diameter of said bores and being substantially the same length as said bores, said rods substantially deviating from the cylindrical shape along part of their length on at least one side;

c. linkage means connecting said rods together so that for all the rods, said deviation from the cylindrical shape on at least one side of the rods is oriented parallel to the longitudinal axis of the heat exchanger in one position of the linkage, said linkage means being further operable to rotate the rods in unison, in an angle about their individual longitudinal axes, and thereby to change the restriction which said rods offer to the flow of said other heat exchange fluid through the slots in the metallic bars intersected by said bores, and further thereby to change the rate of flow of said other heat exchange fluid through the heat exchanger.

19. The heat exchanger of claim 18 wherein said rods extend slightly outside the periphery of the metallic plates, external to the first sealing means and wherein said first sealing means include bore sealing means adjacent each end of the metering control means for sealingly preventing said other heat exchange fluid from leaking out said bores around said rods.

20. The heat exchanger of claim 18 wherein said rods substantially deviate from the cylindrical shape on two diametrically opposite sides.

21. The heat exchanger of claim 18 wherein said rods substantially deviate from the cylindrical shape on ony one side.

22. The heat exchanger of claim 20 or 21 wherein said rods deviate from the cylindrical shape by part of their circumference being flat along a plane in coincidence with a chord extending across the cylindrical shape, said plane being projected parallel to the longitudinal axis of the rods, along their length, between the first sealing means at one edge of the heat exchanger and the first sealing means at the opposite edge.

23. The heat exchanger of claim 22 wherein said chords deviate from the circumference by at least an amount equal to the distance by which the bores intersect said slots, measured along the radius of the bores.

24. A plate type heat exchanger comprising a. a plurality of generally planar metallic plates of similar shape, length, and width, arranged in spaced apart, parallel relationship along a common longitudinal axis;

b. first sealing means for sealingly connecting said metallic plates along the periphery of their facing surfaces, and in conjunction with said metallic plates, defining i. a plurality of shallow, elongated passages between adjacent facing surfaces of said metallic plates;

ii. first inlet means for admitting a vaporous phase heat exchange fluid into first ones of said passages, said first inlet means being disposed adjacent one end of the heat exchanger, and said first passages being non-adjacent to each other;

iii. second inlet means for admitting a liquid phase heat exchange fluid into second ones of said passages, said second inlet means also being disposed adjacent said one end of the heat exchanger, and each of said second passages being adjacent at least one of said first passages, separated by said metallic plates;

iv. outlet means for conveying said vaporous phase and said liquid phase heat exchange fluids in combination out of the heat exchanger, said outlet means being adjacent the other end of the heat exchanger;

c. second sealing means disposed transversely across the longitudinal axis of said metallic plates in said second passages into which said other heat exchange fluid is admitted, said second sealing means extending between the first sealing means at opposite edges of said metallic plates, thereby dividing each of said second passages into a liquid heat exchange fluid passages connected to the second inlet means on one side and a feed fluid passages on the other side of said second sealing means;

d. first distribution means for distributing said vaporous phase heat exchange fluid substantially uniformly across the width of the heat exchanger in said first passages;

e. second distribution means for distributing said liquid phase heat exchange fluid substantially uniformly across the width of the heat exchanger in said liquid heat exchange fluid passages;

f. slots disposed in and passing through the metallic plates separating said first passages conveying said vaporous phase heat exchange fluid from said liquid heat exchange fluid passages which are adjacent thereto, said slots being disposed transversely across the longitudinal axis of the metallic plates such that the second inlet means and the slots are on the same side of the second sealing means, whereby said liquid phase heat exchange fluid may flow into said first passages, and combine with said vaporous phase heat exchange fluid therein, following distribution thereof by the second and first distribution means, respectively;

g. bar means disposed within said liquid heat exchange fluid passages generally parallel to and abridging the slots along their length, and having two sides which are parallel to and in contact with the metallic plates, such that said bar means provide substantial support for the metallic plates in that part of the heat exchanger in which the slots are disposed and further, by inclusion of metering passages connecting said other heat exchange fluid in fluid communication with said slots, are operative to restrict the flow of said other heat exchange fluid through said slots prior to said liquid phase heat exchange fluid mixing with said vaporous phase heat exchange fluid in the first passages; said metering passages constituting an open space having a volume less than the volume of material from which the bar means are formed;

h. feed fluid inlet means for admitting a feed fluid into the feed fluid passages in heat exchange relationship with the combined liquid and vaporous phase heat exchange fluids flowing in said first passages; and i. feed fluid outlet means for conveying the feed fluid out of the heat exchanger.

* * * * *